US011168286B2

(12) United States Patent
Al-Bayati et al.

(10) Patent No.: US 11,168,286 B2
(45) Date of Patent: Nov. 9, 2021

(54) METHOD OF MAKING A DETERGENT COMPOSITION

(71) Applicant: Reckitt Benckiser Finish B.V., Hoofddorp (NL)

(72) Inventors: Alias Younis Al-Bayati, Heidelberg (DE); Gerhard Kämmerer, Heidelberg (DE); Caroline Sabina Rigobert, Rosmalen (NL); Claudia Schmaelzle, Heidelberg (DE); Diego Simionato, Venice (IT); Michela Tasinazzo, Venice (IT)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 95 days.

(21) Appl. No.: 16/326,668

(22) PCT Filed: Aug. 24, 2017

(86) PCT No.: PCT/EP2017/071335
§ 371 (c)(1),
(2) Date: Feb. 19, 2019

(87) PCT Pub. No.: WO2018/037082
PCT Pub. Date: Mar. 1, 2018

(65) Prior Publication Data

US 2019/0185786 A1 Jun. 20, 2019

(30) Foreign Application Priority Data

Aug. 24, 2016 (GB) ..... 1614461

(51) Int. Cl.

| | |
|---|---|
| ***C11D 3/10*** | (2006.01) |
| ***C11D 3/37*** | (2006.01) |
| ***C11D 3/00*** | (2006.01) |
| ***C11D 3/20*** | (2006.01) |
| ***C11D 3/08*** | (2006.01) |

(52) U.S. Cl.
CPC ..... *C11D 3/10* (2013.01); *C11D 3/0015* (2013.01); *C11D 3/08* (2013.01); *C11D 3/2086* (2013.01); *C11D 3/3757* (2013.01)

(58) Field of Classification Search
CPC ..... C11D 3/10; C11D 3/2086; C11D 3/37; C11D 3/3746; C11D 3/3757; C11D 17/043
See application file for complete search history.

(56) References Cited

U.S. PATENT DOCUMENTS

| | | | | |
|---|---|---|---|---|
| 6,228,824 | B1 * | 5/2001 | Gorlin | C11D 1/04 510/223 |
| 2004/0058846 | A1 | 3/2004 | Kistenmacher et al. | |
| 2013/0284210 | A1 * | 10/2013 | Hueffer | C11D 11/02 134/25.2 |
| 2016/0348036 | A1 * | 12/2016 | Beers | C11D 1/66 |

FOREIGN PATENT DOCUMENTS

| | | | | |
|---|---|---|---|---|
| CN | 101679926 | A | 3/2010 | |
| CN | 105861176 | A | 8/2016 | |
| GB | 2529138 | A | 2/2016 | |
| RU | 2323963 | C2 | 1/2006 | |
| WO | 9958633 | A1 | 11/1999 | |
| WO | 2004046292 | A2 | 6/2004 | |
| WO | 2009004512 | A2 | 1/2009 | |
| WO | 2014107578 | A1 | 7/2014 | |
| WO | 2015124384 | A1 | 8/2015 | |
| WO | WO 2015/124384 | * | 8/2015 | C11D 1/66 |

OTHER PUBLICATIONS

Combined Search and Examination Report issued in GB application No. 1614461.0 dated Mar. 16, 2017.
Combined Search and Examination Report issued in GB application No. 1614461.0 dated Jun. 2, 2017.
International Search Report and Written Opinion issued in international application No. PCT/EP2017/071335 dated Oct. 30, 2017.
Westin, K-J et al., "Precipitation of calcium carbonate in the presence of citrate and EDTA," Desalination, 2003, pp. 107-118, vol. 159, Elsevier Science B.V.

* cited by examiner

*Primary Examiner* — Brian P Mruk
(74) *Attorney, Agent, or Firm* — Troutman Pepper Hamilton Sanders LLP; Ryan Schneider; Chris N. Davis

(57) ABSTRACT

A method of making a detergent composition including the following steps in the recited order: providing an aqueous composition comprising a citrate salt; lowering the pH by adding a first, un-neutralized or partially neutralized, polyacrylic acid having a weight average molecular weight in the range of 1000 to 6000 to form a second mixture; increasing the pH by adding alkali metal carbonate and/or alkali metal bicarbonate to form a third mixture; and adding a second polyacrylic acid having a weight average molecular weight in the range of 1000 to 6000 to form a fourth mixture; wherein the detergent composition is preferably an automatic dishwashing detergent composition or a laundry detergent composition.

4 Claims, No Drawings

METHOD OF MAKING A DETERGENT COMPOSITION

TECHNICAL FIELD

The present invention relates to a method of a making a detergent composition. As a result of this method, it is possible to prepare a detergent composition in the form of a free-standing gel-like material without the need for conventional thickeners.

BACKGROUND

Detergent products having a smooth, continuous visual appearance, such as gels, are typically more aesthetically appealing to consumers than compositions in granular, powder or tablet form. They also can be faster-dissolving in use. However, in many applications, such as laundry and machine dishwashing detergents, it is frequently desirable for the detergent product to include a high concentration of active cleaning agent. Flowable liquids or liquid-like gels are unsatisfactory in this regard, because they tend to include high quantities of solvent and/or thickener (used to give the desired rheological properties), limiting the amount of active agent that can be incorporated. If supplied in bulk, the user must measure out the required volume of gel for use for a particular application, and if supplied in a "monodose" form such as in a water soluble pouch, such flowable fluids are liable to leak out of a container if the container material becomes damaged.

Accordingly, there have been efforts to prepare "self-standing gels", whose viscosity is too high to be measured by standard techniques. Because these gels are not flowable, they do not drip or leak out of a container if the container material becomes damaged. Moreover, in some cases there is the opportunity to provide them in a "monodose" form without any enclosing container.

Most such systems are based on anhydrous compositions. For example, WO 2016/024093 discloses a transparent or translucent, anhydrous, self-standing automatic dishwashing gel. The provision of such transparent or translucent formulations presents a challenge in terms of including a high enough concentration of non-dissolved active agents, whilst still allowing light to pass through. On the other hand, the present invention is based on an aqueous system, and the composition may be opaque, so different formulation considerations apply.

Ordinarily, aqueous detergent liquids and gels would often incorporate thickeners such as xanthan gum or high molecular weight, chemically crosslinked polyacrylic acid. Such thickeners tend not to contribute to the cleaning performance. Accordingly, it is one object of the present invention to provide a process for preparing an essentially non-flowable detergent product from an aqueous system, which obviates the need to include a non-active thickener.

It is an alternative and/or additional object to provide a process for preparing a detergent product in the form of a self-standing gel that allows for the inclusion of higher levels of active cleaning agent than in gels of the prior art.

Ideally, if desired the product can also be provided in a water-soluble container without causing dissolution of the container, and is fast-dissolving in use.

The self-standing gel structure of compositions disclosed in WO 2016/024093 may break when subjected to sufficient forces. For example, if cut with a knife, the structure may be destroyed. It would be advantageous to produce a free-standing material that can be processed, e.g. sliced, like a soap bar.

SUMMARY OF THE INVENTION

According to a first aspect, the present invention provides a method of making a detergent composition comprising providing a first mixture of an aqueous composition comprising a citrate salt, lowering the pH of the first mixture by adding a first, un-neutralized or partially neutralized, polyacrylic acid having a weight average molecular weight in the range of 1000 to 6000 to form a second mixture, increasing the pH of the second mixture by adding one or both of alkali metal carbonate and alkali metal bicarbonate to form a third mixture, and adding a second polyacrylic acid having a weight average molecular weight in the range of 1000 to 6000 to form a fourth mixture, wherein the detergent composition is preferably an automatic dishwashing detergent composition or a laundry detergent composition.

In a second aspect of the invention there is provided a method comprising the method of making the detergent composition according to the first aspect, and further comprising pouring the detergent composition into a mould or container and allowing the detergent composition to form inside the mould or container. If a container, preferably the container is a water-soluble container. Further, allowing the detergent composition "to form" can mean allowing the detergent composition to harden, solidify or set inside the mould or container.

In a third aspect of the invention there is provided a detergent composition obtainable by the method of the first aspect.

In a fourth aspect of the invention there is provided a detergent composition comprising water, polyacrylic acid or a salt thereof, having a weight average molecular weight in the range of 1000 to 6000, citrate, and one or both of alkali metal carbonate and alkali metal bicarbonate, wherein the detergent composition is in the form of a self-standing gel.

According to a fifth aspect, the present invention provides a water-soluble container containing the detergent composition of the third or fourth aspects.

According to a sixth aspect, the present invention provides a cleaning process using the detergent composition of the third or fourth aspects, or the container of the fifth aspect.

According to a seventh aspect, the present invention provides the use of the detergent composition of the third or fourth aspects, or the container of the fifth aspect, for cleaning.

DETAILED DESCRIPTION

The present inventors have found that by successively lowering and raising the pH in the manner described herein and by adding low molecular weight polyacrylic acid in two stages, it is possible to prepare a detergent product with the required physical properties, without requiring a conventional thickener. While the citrate and polyacrylic acid already provide a builder function, it is possible to incorporate additional actives into the process without compromising the physical form of the product. Thus, the method of the invention allows for the preparation of a product containing high levels of active cleaning agent. It has been found that the pH cycling of the method is critical: if the first polyacrylic acid that is added is fully neutralised, or the buffering step (c) is omitted, the mixture does not set properly. It is also essential to add polyacrylic acid in two stages, as opposed to entirely in step (b). Without wishing to be bound by theory, it is thought that the pH control and stepwise addition of polyacrylic acid, together with the inclusion of citrate as opposed to other known builders, control the self-assembly mechanism of the molecules in the carrier (water), and thereby influence the physical state of the final product.

The product may behave like a soap bar and may alternatively be described as a self-standing gel or structured fluid.

The product can be used as a detergent formulation in cleaning applications, especially automatic cleaning applications such as laundry cleaning machines and automatic dishwashing machines. It may be provided in monodose form, for instance in a water-soluble container.

WO 2009/004512 discloses a "solidification matrix" in the form of a hydrate solid, comprising water, sodium polyacrylate, sodium carbonate and a small amount of sodium citrate. However, it is formed using a different method from the present invention and does not result in a self-standing gel.

The present invention will now be described further. In the following passages, different aspects/embodiments of the invention are defined in more detail. Each aspect/embodiment so defined may be combined with any other aspect/embodiment or aspects/embodiments unless clearly inconsistent or indicated to the contrary. In particular, any feature indicated as being preferred or advantageous may be combined with any other feature or features indicated as being preferred or advantageous.

The present invention provides a method of making a detergent composition. The method involves a number of steps. As will be appreciated, while these steps are not carried out in parallel, there may be some overlap between the steps when the process is carried out in a continuous manner. Preferably however, addition of the specified ingredient is completed before the next step begins.

In step (a), an aqueous composition comprising a citrate salt is provided. Preferably, the citrate is a water-soluble citrate, preferably an alkali metal citrate, such as sodium or potassium citrate, more preferably sodium citrate. A suitable exemplary source of citrate is trisodium citrate dihydrate. The present inventors have found that the use of a citrate in this step is important for the formation of a final product with the required physical properties. In particular, if other known builders such as acetate, formate, maleate, L-lactate or phosphonate are used instead, the desired setting at the end of the process does not occur. It is thought that this is due do the nature of the aqueous complex formed between the citrate and the subsequently added polyacrylic acid, which serves to guide the self-assembly process.

The aqueous citrate composition may be formed by simple mixing of water and citrate in solid form. Optionally, other ingredients may be included, such as co-builder(s) and dispersant polymer(s). Examples of these include phosphonate, methylglycinediacetic acid (MGDA), and sulphonated polymers. Preferably, the aqueous composition has a pH of 5 or higher. For example, the aqueous composition may be alkaline, preferably having a pH of at least 8, 9.5, 9, or 9.5, and/or a pH no more than 14, 13, 11 or 10.5. The aqueous composition may be acidic or neutral, preferably having a pH of at least 5, 5.5, or 6, and/or a pH no more than 7, 6.8, or 6.5.

Step (b) involves adding a first polyacrylic acid (un-neutralised or partially neutralised, but preferably partially neutralised) to the composition, thereby lowering the pH and forming a second mixture. The term "polyacrylic acid" as used herein refers to a homopolymer of acrylic acid monomer units. By the term "un-neutralised" it is meant that all of the acrylic acid units of the polymer are present in free acid form. By the term "partially neutralised" it is meant that a portion of the acrylic acid units are present as a salt (preferably as an alkali metal salt, e.g. as a sodium acrylate), as opposed to the free acid. Preferably at least 20%, at least 30%, or at least 40% of the acrylic acid units are present as a salt, and/or no more than 80%, 70% or 60% of the acrylic acid units are present as a salt. Advantageously, at a pH of 4, from 10 to 40% of the acrylic acid units are present as a salt, more advantageously from 20 to 35%, and most advantageously, from 22 to 30% of the acrylic acid units are present as a salt.

It is to be understood that the terms "un-neutralised" and "partially-neutralised" refer to the state of the polyacrylic acid at the point at which it is added to the composition, and not necessarily to its state in the final product. In an embodiment, a 10 wt % solution of the polyacrylic acid in water has a pH of: 6.5 or less, preferably 6.0 or less, 5.5 or less, 5.0 or less, or 4.5 or less; and/or at least 2.0, at least 2.5, at least 3.0, or at least 3.5.

The polyacrylic acid has a weight average molecular weight in the range of 1000 to 6000, preferably at least 2000, at least 3000 or at least 3500 and/or no more than 5000, no more than 4800 or no more than 4500. The present inventors have found that the method of the invention allows for the incorporation of a low-molecular weight polyacrylic acid, which acts as a co-builder, into a product with the required physical properties. Surprisingly, it has been found that when a polyacrylic acid having a weight average molecular weight outside this range (e.g. 8000) is used instead, the desired properties are not achieved. This is surprising because it would be expected that a higher molecular weight polyacrylic acid would be more likely to solidify. Indeed, polyacrylic acids having a high molecular weight (typically over 50,000) are known in the art as conventional thickeners, and there is a prejudice in that low molecular weight polyacrylic acids are difficult to solidify.

Preferably, the polyacrylic acid is not cross-linked. This further distinguishes the polyacrylic acid used in the present invention from conventional polyacrylic acid thickeners.

Suitable partially-neutralised polyacrylic acids for use in the present invention include Sokalan PA 25 CL PN (weight average molecular weight of 4000), available from BASF, and Acusol 445 (weight average molecular weight of 4500), available from Dow.

The use of an un-neutralised or partially-neutralised polyacrylic acid in step (b) lowers the pH of the first mixture. This pH control has been found to be important for the formation of the desired final product. In particular, if fully neutralised polycarboxylic acids (such as Acusol 445N) are used instead, the desired setting does not occur. Preferably, addition of the un-neutralised or partially-neutralised polyacrylic acid lowers the pH of the composition by at least 0.5 units, preferably at least 0.7, 1, 2 or 3 units, and/or preferably no more than 4 or 3.5 units. In an embodiment, the pH of the second mixture is at least 5, 5,5 or 6 and/or no more than 7 or 6.5.

Step (c) involves adding alkali metal carbonate and/or alkali metal bicarbonate, thereby increasing the pH of the composition and providing a third mixture. The present inventors have found the buffering/pH control provided by the alkali metal carbonate and/or alkali metal bicarbonate is important for the formation of the final product. In particular, if other bases such as phosphates or disilicates are used instead, the desired setting at the end of the process does not occur. Without wishing to be bound by theory, it is thought that the increase in pH at this stage is necessary to control the molecular self-assembly process.

Preferably, addition of the alkali metal carbonate and/or alkali metal bicarbonate raises the pH of the composition by at least 0.5 units, preferably at least 1, 2, 3 or 4 units, and/or preferably no more than 6 or 5 units. Preferably, the pH of the third mixture is at least 9 or 9.5 and/or no more than 11 or 10.5.

Preferably, the alkali metal carbonate and/or alkali metal bicarbonate is selected from the group consisting of sodium carbonate, potassium carbonate, sodium bicarbonate, potassium bicarbonate and mixtures of two or more thereof. More preferably sodium carbonate is used.

Step (d) involves adding a second polyacrylic acid to form a fourth mixture. The polyacrylic acid has a weight average molecular weight in the range of 1000 to 6000, preferably at least 2000, at least 3000 or at least 3500 and/or no more than 5000, no more than 4800 or no more than 4500. The second polyacrylic acid may be un-neutralised, partially-neutralised or fully-neutralised. It is to be understood that the terms "un-neutralised", "partially-neutralised" and "fully-neutralised" refer to the state of the polyacrylic acid at the point at which it is added to the composition, and not necessarily to its state in the fourth mixture or in the finished product. Moreover, it will be appreciated that the second polyacrylic acid is not necessarily the same as the first polyacrylic acid. However, it is preferred that they are the same, i.e. two portions of the same polyacrylic acid are added to the composition at different times.

In an embodiment, the pH of the fourth mixture is at least 8 or 8.5 and/or no more than 10 or 9.5. Preferably, the pH of the fourth mixture is lower than that of the third mixture. It will be appreciated that the pH in this step is influenced by the form of the polyacrylic acid used. Where partially- or fully-neutralised polyacrylic acid is used in the present invention, it is preferred that the polyacrylic acid is in the form of a sodium salt. However, other alkali metal salts, such as potassium salts, may be used.

Preferably, the first polyacrylic acid and the second polyacrylic acid are added in a weight ratio of at least 1:5, at least 1:4, or at least 1:3, and/or no more than 5:1, no more than 4:1, or no more than 3:1. In an embodiment, this weight ratio is about 1:2.

The present inventors have found that the use of a polyacrylic acid in the method of the invention is important for the formation of the desired final product. In particular, it has been found that if the first and/or second portions of polyacrylic acid are replaced with other acidic polymers such as other polycarboxylates, the desired setting at the end of the process does not occur. Moreover, it has been found that polyacrylic acids having a molecular weight above 6000 (such as Sokalan PA30 CL, weight average molecular weight approximately 8000) do not give the desired properties. As noted above, this is surprising because higher molecular weight polyacrylic acids are known as conventional thickeners. Where the polyacrylic acid to be added is a solid, it may optionally be pre-dissolved in an aqueous medium such as water before it is added in steps (b) and/or (d).

At the end of the process, the composition may be allowed to harden, solidify, set or gel, optionally after having been poured into a mould or container, preferably a water-soluble container.

As noted above, the method of the invention may advantageously allow for the preparation of a detergent composition in the form of a self-standing gel, without requiring a thickener. By "self-standing" it is meant that the gel retains its shape and does not flow at 20° C., 1 atm pressure. Accordingly, the composition is too viscous for reliable viscosity measurements to be made at 20° C. using a device such as a Brookfield viscometer. In an embodiment, the gel starts to melt/flow on heating at a temperature of 40° C. or higher, 45° C. or higher, 50° C. or higher, 55° C. or higher, or 60° C. or higher. Complete melting/transition to a flowable liquid may occur over a temperature range, and is preferably complete by 90° C. or less, 85° C. or less, 80° C. or less, 75° C. or less, 70° C. or less, or 65° C. or less.

In an embodiment, the product of the inventive method is a structured fluid.

In an embodiment, the product of the inventive method is a self-supporting soft solid.

In an embodiment, the product of the inventive method can be cut with a knife and the resulting pieces retain the same physical structure.

Conventional thickeners include carbomers, xanthan gum and derivatives thereof, agar agar, gelatine, polyvinylpyrrolidone (PVP), polyethylene glycol (PEG), maltodextrin, cellulose ethers, hydroxyethylcellulose, ASE thickeners (alkali-swellable emulsion), HASE thickeners (hydrophobically modified alkali-swellable emulsion) and HEUR thickeners (hydrophobically modified ethylene oxide-based urethane). Preferably, the composition comprises less than 0.5 wt %, less than 0.1 wt %, less than 0.05 wt %, less than 0.01 wt %, or less than 0.001 wt %, of one or more of these thickeners. Preferably, it is substantially free of all of these thickeners. The composition most preferably does not comprise a thickener at all (the compulsory polyacrylic acid is not considered a thickener in this context).

Preferably, the method further comprises adding a bleach after step (c) and/or before step (d). The bleach may be added in the form of an aqueous solution. Surprisingly and unexpectedly, it has been found that it is possible to incorporate bleach into the compositions of the present invention, without compromising the desired chemical or physical properties of the composition (bleaches often cause instability issues, especially in aqueous systems). In contrast, adding the bleach after step (d) has been found to prevent the composition from gelling/solidifying satisfactorily.

The bleach may be a chlorine-based or oxygen-based bleaching compound. Examples of chlorine-based bleaches include hypochlorite salts such as sodium hypochlorite. The oxygen-based bleach may be hydrogen peroxide or a precursor thereof, for example an inorganic perhydrate salt (such as a persulphate, perborate or percarbonate, preferably an alkali metal salt thereof, preferably sodium percarbonate) or an organic peracid or salt thereof.

In an embodiment, the method comprises adding an active agent selected from the group consisting of surfactants (which may be non-ionic, anionic, cationic or zwitterionic), enzymes, anti-corrosion agents, builders, and mixtures of two or more thereof. Suitable active agents are described herein. Fragrances and/or dyes can also be included. The stage at which such agents are added is not critical, but preferably the key pH control elements of the present method are still satisfied, that is, the pH of the second mixture is lower than that of the aqueous composition, and the pH of the third mixture is greater than that of the second mixture. Because the citrate and polyacrylic acid perform a builder/co-builder function and various other active agents are compatible with the method, effective detergent compositions can be prepared having high levels of cleaning agents incorporated therein.

Advantageously, the method of the present invention can be carried out without any active heating (no externally applied heat). However, it will be appreciated that the temperature of the mixture at a given point of the process may be higher than room temperature owing to the self-heating nature of some of the reactions.

Advantageously, the detergent composition formed in the present invention has a high solubility in warm water, despite its hardness. Without wishing to be bound by theory, it is thought that this is due to the self-assembly mechanism of the method referred to herein: because the molecules self-assemble in water as a carrier, they can readily disassemble when diluted in water. The solubility can be quantified by the following method:

A 1 litre glass beaker is filled with 800 ml water which is at 45° C. and has a hardness of 18° gH. The beaker is equipped with a magnetic stirrer bar rotating at 250 revolutions per minute. A 2 g cube of composition is placed inside a tea strainer of the spherical clam-shell type (diameter of mesh ball 4.5 cm, with 0.7 mm holes in the mesh) and immersed in the water above the stirrer bar. The time it takes for the composition to be fully dissolved (by visual inspection, no composition left inside the tea strainer) is measured. In an embodiment, the dissolution time of the composition according to this method is 20 minutes or less, preferably 19, 18, 17, 16, 15, 14, 13, 12, 11 or 10 minutes or less.

Preferably, when freshly prepared, the water content of the detergent composition made in the present invention is: at least 5 wt %, preferably at least 10 wt %, 15 wt %, 20 wt %, 25 wt %, 30 wt %, 35 wt %, 40 wt %, 45 wt %, or 50 wt %; and/or no more than 70 wt %, preferably no more than 65 wt %, 60 wt %, or 55 wt %. However, it is possible that some water is lost on storage.

Depending on the precise method used to prepare the composition, and in particular on the final pH of the composition, the polyacrylic acid may be present in partially-neutralised or fully-neutralised form, even though the methods disclosed herein require the addition of un-neutralised or partially-neutralised polyacrylic acid in step (b). Preferably, the total amount of polyacrylic acid in the final detergent composition is at least 5 wt %, at least 6 wt %, or at least 8 wt %, and/or no more than 20 wt %, 15 wt %, 12 wt % or 10 wt %.

Preferably, the alkali metal carbonate and/or alkali metal bicarbonate is present in the final detergent composition in an amount of at least 5 wt %, preferably at least 8 wt %, 10 wt %, or 12 wt %, and/or no more than 20 wt %, 18 wt % or 16 wt %.

Preferably, the citrate is present in the detergent composition an amount of at least 10 wt %, preferably at least 15 wt %, 17 wt % or 20 wt %, and/or no more than 30 wt %, 25 wt % or 23 wt %.

In certain exemplary embodiments, the composition consists essentially of or consists of the water, the polyacrylic acid, the citrate and the alkali metal carbonate and/or alkali metal bicarbonate. As is shown in the Examples, no other components are necessary to provide the required physical properties when the method steps described herein are followed. Moreover, the polyacrylic acid and citrate already perform a cleaning function.

Preferably, however, the composition further comprises an active agent selected from the group consisting of surfactants, enzymes, anti-corrosion agents, builders, and mixtures of two or more thereof. Each of such active agents may be present in an amount of at least 1 wt %, 2 wt %, or 5 wt %, and/or up to 30 wt %, 20 wt %, 15 wt % or 10 wt %. The versatility of the method of the invention allows for a variety of active agents to be incorporated into the composition in significant amounts.

Suitable surfactants include non-ionic, anionic, cationic, or amphoteric/zwitterionic surfactants. Where the composition is for use in automatic dishwashing, the surfactant is preferably a non-ionic surfactant. Suitable non-ionic surfactants include alcohol alkoxylates, preferably alcohol ethoxylates or alcohol propoxylate ethoxylates, preferably ethoxylated fatty alcohols or fatty alcohol propoxylate ethoxylates. Suitable surfactants can be found, for example, in the Lutensol™ and Plurafac™ ranges from BASF, the Tergitol™ range from Dow, and the Genapol™ range from Clariant. Suitable surfactants are described in WO 2016/024093, which is incorporated herein by reference. Where the composition is for use in laundry washing, the surfactant is preferably an anionic or cationic surfactant. Suitable such surfactants are known in the art.

Where the active agent is or includes one or more enzymes, these are preferably selected from the group consisting of proteases, amylases, cellulases, pectinases, mannanases, lipases, glucose oxidase, peroxidases, ester-transferases and mixtures of two or more thereof. Preferably, an amylase and/or protease is included. The enzyme may be liquid or solid, although preferred enzymes are solid granulated enzymes or combinations of granules of different enzymes.

Suitable anti-corrosion agents are known to those skilled in the art and include glass corrosion inhibitors like zinc, zinc compounds, bismuth, bismuth compounds, and polyalkyleneimine such as polyethyleneimine. Inhibitors of metal corrosion include benzotriazole and tolyltriazole.

Suitable calcium chelating agents/builders are known to those skilled in the art, and include amino acid-based builders, such as methylglycinediacetic acid (MGDA), glutamic acid diacetic acid (GLDA), and salts thereof, as well as phosphonates, such as 1-hydroxyethane-1,2-diphosphonic acid (HEDP). In an embodiment, the composition is free of phosphates.

When the composition comprises a bleach, this is preferably in an amount of at least 0.05 wt %, 0.1 wt %, or 0.15 wt %, preferably up to 5 wt %, 3 wt %, or 2 wt %. As noted above, the methods described herein advantageously allow for the incorporation of bleaching compounds, which are typically difficult to incorporate into solid gel-type products. In another embodiment, the composition is bleach-free.

Preferably, the set/gellified mixture is provided in a water-soluble container. The container may be a single compartment or a multi-compartment container. The term "water-soluble" as used herein encompasses "water-dispersible". Preferably, the water-soluble container is formed of a water-soluble polymer and optionally one or more additives such as a plasticiser or filler. Suitable polymers include polyvinylalcohol (PVOH) or a PVOH copolymer. Partially hydrolysed PVOH, as known in the art, is particularly suitable. Suitable containers are described in WO 2016/024093, which is incorporated herein by reference. Nevertheless, the compositions of the present invention may be used without a water-soluble container. This is owing to their self-standing nature and reasonable resistance to deformation.

A variety of cleaning uses can be envisaged for the compositions of the present invention. Preferably, however, the composition is in the form of an automatic dishwashing detergent or a laundry detergent.

The present invention will now be described in relation to the following non-limiting Examples.

EXAMPLES 1-7

Seven compositions were prepared in accordance with the method of the present invention, with the order in which the components were added indicated in the table below. The components were added without active heating (although the temperature of the mixture was sometimes above room temperature owing to the self-heating nature of some of the reactions). The mixture was stirred and/or homogenised where appropriate. In each Example, after the last addition, the composition was a fluid exhibiting good pourability, and was poured into an ice-cube tray whereupon it exhibited fast drying to a self-standing "gel-like" product with consistency and physical properties similar to a soap bar.

It can be seen that the combination of water, citrate, carbonate and two portions of partially neutralised polyacrylic acid in the stated orders give rise to a self-standing "gel" product (Example 1). It is thought that the citrate, the partially neutralised state of the first portion of polyacrylic acid and the carbonate have an important pH cycling effect.

Examples 2-7 show that various active agents can be added at different stages of the process without compromising the physical characteristics of the product, provided that the basic pH cycling is not disturbed.

| | | Example 1 | | Example 2 | | Example 3 | | Example 4 | | Example 5 | | Example 6 | | Example 7 | |
|---|---|---|---|---|---|---|---|---|---|---|---|---|---|---|---|
| Step | Ingredient | % | pH# | % | pH# | % | pH# | % | pH# | % | pH# | % | pH# | % | pH# |
| 1 | Water | 38.7 | | 36.7 | | 36.1 | | 21.2 | | 31.3 | | 17.4 | | 17.1 | |
| 2 | HEDP | — | — | — | — | 2.4 | — | 2.2 | — | 2.4 | — | — | — | 2.2 | — |
| 3 | Trisodium citrate | 23.1 | 8.7 (at 23° C.) | 21.9 | 8.37 (at 30° C.) | 21.6 | 10.2 (at 28° C.) | 19.8 | — | 21.1 | 10.4 (at 32° C.) | 19.8 | — | 19.3 | — |
| 4 | MGDA Solution (40%) | — | — | — | — | — | — | 19.8 | 13.4 (at 34° C.) | — | — | 19.8 | 13.2 (at 29.7° C.) | 19.3 | 13.7 (at 32° C.) |
| 5 | Sulfonated polymer (37% solution) | — | — | — | — | — | — | — | — | 6.3 | 6.64 (at 36° C.) | 5.9 | 9.64 (at 33.5° C.) | 5.8 | 9.7 (at 36° C.) |
| 6 | Polyacrylic acid, partly neutralised, 49% solution## | 7.9 | 5.5 (at 23° C.) | 7.4 | 5.75 (at 35° C.) | 6.5 | 5.81 (at 32.1° C.) | 9.8 | 6.4 (at 41.3° C.) | 6.3 | 5.68 (at 35.5° C.) | 6.5 | 6.4 (at 45° C.) | 6.4 | 6.62 (at 45.4° C.) |
| 7 | Non-ionic surfactant, 20% solution | — | — | 5.5 | 5.74 (at 37.5° C.) | 5.4 | 5.79 (at 36° C.) | 5.0 | 6.4 (at 45° C.) | 5.3 | 5.57 (at 38.7° C.) | 4.9 | 6.4 (at 46.5° C.) | 4.8 | 6.75 (at 50° C.) |
| 8 | Sodium carbonate | 16.2 | 10.4 (at 29° C.) | 15.3 | 10.4 (at 59.8° C.) | 15.1 | 10.32 (at 48.5° C.) | 13.9 | 9.7 (at 66° C.) | 14.7 | 10.31 (at 53° C.) | 13.8 | 9.84 (at 58° C.) | 13.5 | 9.76 (at 59.7° C.) |
| 9 | Polyacrylic acid, partly neutralised 49% solution## | 14.1 | 9.5 (at 28° C.) | 13.2 | 9.2 (at 57.6° C.) | 13.0 | 9.18 (at 53.2° C.) | 8.4 | 9.2 (at 65° C.) | 12.6 | 9.19 (at 56.5° C.) | 11.9 | 8.97 (at 65° C.) | 11.6 | 9.03 (at 65.5° C.) |

#at end of addition step
Sokalan PA 25 CL PN liquid

COMPARATIVE EXAMPLES 8-10

In each of these Comparative Examples, one of the polyacrylic acid, citrate and carbonate components was omitted. In other respects, the method was in accordance with that of Example 1.

| | | Comparative Example 8 | | Comparative Example 9 | | Comparative Example 10 | |
|---|---|---|---|---|---|---|---|
| Step | Ingredient | % | pH# | % | pH# | % | pH# |
| 1 | Water | 28.5 | | 21.2 | | 19.7 | |
| 2 | HEDP | 2.4 | — | 2.7 | — | 2.5 | — |
| 3 | Trisodium citrate | 21.3 | 10.22 (at 28° C.) | — | — | 22.3 | — |
| 4 | MGDA Solution 40% | 21.3 | 13.7 (at 30° C.) | 24.0 | 12.9 (at 30° C.) | 22.3 | 13 (at 33° C.) |
| 5 | Sulfonated polymer, 37% solution | 6.4 | 9.6 (at 38° C.) | 7.2 | 9.68 (at 32.7° C.) | 6.7 | 9.4 (at 40° C.) |
| 6 | Polyacrylic acid, partly neutralised, 49% solution## | — | — | 7.9 | 6.43 (at 38.2° C.) | 7.4 | 6.7 (at 43° C.) |

-continued

| Step | Ingredient | Comparative Example 8 % | Comparative Example 8 pH# | Comparative Example 9 % | Comparative Example 9 pH# | Comparative Example 10 % | Comparative Example 10 pH# |
|---|---|---|---|---|---|---|---|
| 7 | Surfactant, 20% solution | 5.3 | 9.4 (at 41° C.) | 6.0 | 6.5 (at 40.8° C.) | 5.6 | 6.76 (at 44° C.) |
| 8 | Sodium carbonate | 14.9 | 10.55 (at 55° C.) | 16.8 | 9.6 (at 56° C.) | — | — |
| 9 | Polyacrylic acid, partly neutralised 49% solution## | — | — | 14.4 | 8.9 (at 57.8° C.) | 13.4 | 5.6 (at 45° C.) |

#at end of addition step

Sokalan PA 25 CL PN liquid

All these samples formed a fluid product with good pourability. For Comparative Examples 8 and 10, after 1 day it had still not formed the solidified/gel-like state.

Instead, a separated inhomogeneous liquid was seen. Comparative Example 9 did not completely gel/solidify.

This shows that each of the polyacrylic acid, the citrate and the carbonate components are essential for the desired physical characteristics of the product to be obtained.

EXAMPLES 11 & 12

In the following examples, the core components (citrate, polyacrylic acid and carbonate) were combined with cationic surfactants. In other respects, the method was in accordance with that of Example 1.

| Step | Ingredient | Example 11 % | Example 11 pH# | Example 12 % | Example 12 pH# |
|---|---|---|---|---|---|
| 1 | Water | 38.0 | | 39.7 | |
| 2 | Trisodium citrate | 22.8 | 8.9 (at 23° C.) | 21.8 | 8.65 (at 24° C.) |
| 3 | Polyacrylic acid, partly neutralised, 49% solution## | 8.0 | 5.68 (at 26° C.) | 7.3 | 5.74 (at 26° C.) |
| 4 | Cationic surfactant### | 1.5 | 5.67 (at 30° C.) | — | — |
| 4 | Cationic surfactant 50% (benzalkonium chloride) | — | — | 2.8 | 5.75 (at 28° C.) |
| 5 | Sodium carbonate | 15.9 | 10.1 (at 40° C.) | 15.3 | 10.51 (at 42° C.) |
| 6 | Polyacrylic acid, partly neutralised, 49% solution## | 13.9 | 9.4 (at 45° C.) | 13.1 | 9.18 (at 44° C.) |

#at end of addition step

Sokalan PA 25 CL PN liquid

ESTERQUAT 18 FS

ESTERQUAT 18 FS is available from BASF and BAC 50 is available from Airedale Chemical.

In both cases, a self-standing "gel" was obtained like in Example 1. These Examples demonstrate that cationic, and not merely non-ionic, surfactants can be incorporated into the compositions of the invention without compromising their physical characteristics.

EXAMPLE 13 & COMPARATIVE EXAMPLE 14

The following composition comprising a bleaching compound was prepared in accordance with the method of Example 1:

| | | Example 13 | |
|---|---|---|---|
| Step | Ingredient | % | pH# |
| 1 | Water | 16.5 | |
| 2 | HEDP | 2.1 | |
| 3 | Trisodium citrate | 18.7 | |
| 4 | MGDA solution 40% | 18.7 | 12.5 (at 36° C.) |
| 5 | Sulfonated polymer, 37% solution | 5.6 | 9.12 (at 37° C.) |
| 6 | Polyacrylic acid, partly neutralised, 49% solution## | 6.4 | 6.64 (at 40° C.) |
| 7 | Surfactant, 20% solution | 4.7 | 6.66 (at 40° C.) |
| 8 | Sodium carbonate | 13.1 | 9.6 (at 54° C.) |

-continued

| | | Example 13 | |
|---|---|---|---|
| Step | Ingredient | % | pH# |
| 9 | Sodium hypochlorite 5% | 3.0 | 9.6 (at 52° C.) |
| 10 | Polyacrylic acid, partly neutralised, 49% solution## | 11.2 | 9.2 (at 50° C.) |

#at end of addition step

Sokalan PA 25 CL PN liquid

In Example 13, a semi-solid, self-standing "gel" like in Example 1 was obtained at the end of mixing, and this state was retained after 5 days.

A further composition (Comparative Example 14) was prepared in which the bleach was added after the second portion of polyacrylic acid rather than before. The remaining aspects of the process and the amounts of the components were identical to those of Example 13. Comparative Example 14 was sticky, and the desired gelling/solidification had not occurred either after mixing or after five days. Accordingly, it can be concluded that where bleach is to be included, the point at which the bleach is added is important.

COMPARATIVE EXAMPLES 15 & 16

The following compositions were prepared in which the citrate was replaced with other carboxylic acid salts (formate and acetate):

| | | Comparative Example 15 | | Comparative Example 16 | |
|---|---|---|---|---|---|
| Step | Ingredient | % | pH# | % | pH# |
| 1 | Water | 38.67 | 38.67 | | |
| 2 | Sodium formate anhydrous | 23.13 | 9.0 (at 27.7° C.) | — | — |
| 2 | Sodium acetate trihydrate | — | — | 23.13 | 9.24 (at 15° C.) |
| 3 | Polyacrylic acid, partly neutralised, 49% solution## | 7.87 | 7.9 (at 16.0° C.) | 7.87 | 5.53 (at 25° C.) |
| 4 | Sodium carbonate | 16.24 | 10.2 (at 49.0° C.) | 16.24 | 10.34 (at 44.4° C.) |
| 5 | Polyacrylic acid, partly neutralised, 49% solution## | 14.09 | 9.0 (at 54.4° C.) | 14.09 | 8.96 (at 50° C.) |

#at end of addition step

Sokalan PA 25 CL PN liquid

In other respects, the method was in accordance with Example 1. Both methods resulted in a spreadable paste with pour pourability, which after time formed a gel-like but non self-standing product.

This shows that replacing citrate with formate or acetate compromises the physical properties of the composition, even though a similar pH is obtained after addition step 2 as when citrate was used in Example 1, and the key pH cycling aspects of the invention are still present.

COMPARATIVE EXAMPLES 17 & 18

The following compositions were prepared in which the carbonate was replaced with other alkaline ingredients (disilicate or tripolyphosphate):

| | | Comparative Example 17 | | Comparative Example 18 | |
|---|---|---|---|---|---|
| Step | Ingredient | % | pH# | % | pH# |
| 1 | Water | 38.67 | | 38.67 | |
| 2 | Trisodium citrate | 23.13 | 8.52 (at 23° C.) | 23.13 | 8.13 (at 27° C.) |
| 3 | Polyacrylic acid, partly neutralised, 49% solution## | 7.87 | 5.67 (at 26° C.) | 7.87 | 5.31 (at 30° C.) |
| 4 | Sodium disilicate | 16.24 | 10.31 (at 49° C.) | — | — |
| 4 | Sodium tripolyphosphate | — | — | 16.24 | 5.63 (at 40° C.) |
| 5 | Polyacrylic acid, partly neutralised 49% solution## | 14.09 | 5.66 (at 48° C.) | 14.09 | 5.11 (at 46.8° C.) |

#at end of addition step
Sokalan PA 25 CL PN liquid

In other respects, the method was in accordance with Example 1. Comparative Example 17 resulted in an opaque liquid which did not solidify. Comparative Example 18 resulted in a liquid with good pourability; there was visible separation of two liquid phases and the product did not solidify. This shows that replacing carbonate with disilicate or tripolyphosphate compromises the physical properties of the composition.

COMPARATIVE EXAMPLE 19

The following composition was prepared in which the partially neutralised polyacrylic acid was replaced with another partially neutralised polyacrylic acid having a higher molecular weight (Sokalan PA30 CL; weight average molecular weight approximately 8000).

| | | Comparative Example 19 | |
|---|---|---|---|
| Step | Ingredient | % | pH at end of addition step |
| 1 | Water | 49.87 | |
| 2 | Sodium citrate | 23.13 | 8.22 (at 25.8° C.) |
| 3 | Sokalan PA 30 CL PN powder | 3.86 | 5.64 (at 31.2° C.) |
| 4 | Sodium carbonate | 16.24 | 10.37 (at 52° C.) |
| 5 | Sokalan PA 30 CL PN powder | 6.90 | 9.25 (at 65° C.) |

In other respects, the method was in accordance with Example 1. The product gelled to form a sticky paste. As can be seen from the table and Example 1, the molecular weight of the polyacrylic acid is critical for obtaining the desired product characteristics.

COMPARATIVE EXAMPLE 20

The following composition was prepared in which a fully neutralised polyacrylic acid having a similar molecular weight (Acusol 445N; Mw 4500) was used instead of the partially neutralised polyacrylic acid (Sokalan PA 25 CL PN liquid; Mw 4000). In other respects, the method was in accordance with Example 1.

| | | Comparative Example 20 | |
|---|---|---|---|
| Step | Ingredient | % | pH at end of addition step |
| 1 | Water | 36.72 | |
| 2 | Sodium citrate | 23.13 | 8.23 (at 28.3° C.) |
| 3 | Acusol 445N (45% solution) | 8.57 | 7.71 (at 29.4° C.) |
| 4 | Sodium carbonate | 16.24 | 11.50 (at 52° C.) |
| 5 | Acusol 445N (45% solution) | 15.34 | 11.28 (at 50° C.) |

The resulting composition was in liquid form and there was visible separation of two liquid phases. This shows that using neutralised polyacrylic acid rather than partially neutralised polyacrylic acid compromises the physical properties of the composition.

The foregoing detailed description has been provided by way of explanation and illustration, and is not intended to limit the scope of the appended claims.

The invention claimed is:

1. A detergent composition comprising:

20 wt % to 55 wt % of water;

10 wt % to 15 wt % of polyacrylic acid or a salt thereof, having a weight average molecular weight in the range of 1000 to 6000;

10 wt % to 30 wt % of citrate; and 5 wt % to 20 wt % of one or both of alkali metal carbonate and alkali metal bicarbonate;

wherein the detergent composition is in the form of a gel that retains a shape and does not flow at 20° C., 1 atm pressure.

2. The detergent composition according to claim 1, wherein:

the citrate is present from 15 wt% to 25 wt %; and the one or both alkali metal carbonate and alkali metal bicarbonate are present from 8 wt % to 15 wt %.

3. The detergent composition according to claim 2 further comprising one or more of a surfactant, an enzyme, an anti-corrosion agent, and a calcium chelating agent.

4. A detergent system comprising:

a water-soluble container; and the detergent composition of claim 2;

wherein the container contains the detergent composition.

* * * * *